US007404242B1

(12) United States Patent
Perler

(10) Patent No.: US 7,404,242 B1
(45) Date of Patent: Jul. 29, 2008

(54) LACE SECURING APPARATUS

(76) Inventor: Janelle Perler, 9400 SW. 49th Pl., Cooper City, FL (US) 33328

( * ) Notice: Subject to any disclaimer, the term of this patent is extended or adjusted under 35 U.S.C. 154(b) by 44 days.

(21) Appl. No.: 11/333,154

(22) Filed: Jan. 17, 2006

(51) Int. Cl.
*A43C 7/00* (2006.01)

(52) U.S. Cl. ..... 24/712.2; 24/712.3; 24/712.4; 24/442; 36/136; 36/137; 36/138; 36/139; 2/245; 2/247

(58) Field of Classification Search ..... 24/712.2; 63/19, 18, 23, 22, 21, 20
See application file for complete search history.

(56) References Cited

U.S. PATENT DOCUMENTS 3,473,198 A * 10/1969 Meier ..... 24/712.3
5,022,127 A * 6/1991 Ang ..... 24/712.2
5,031,420 A * 7/1991 Song ..... 63/21
5,353,483 A * 10/1994 Louviere ..... 24/712.1
5,414,948 A * 5/1995 Kudo ..... 40/651
5,778,500 A * 7/1998 Illingworth ..... 24/712.3
5,913,483 A * 6/1999 Polk ..... 24/712.3
D413,542 S * 9/1999 Guarino ..... D11/74
6,000,111 A * 12/1999 Deskins et al. ..... 24/712.3
6,588,078 B2 * 7/2003 Writt et al. ..... 24/712.2
6,601,323 B2 * 8/2003 Tsujino et al. ..... 36/136
6,823,610 B1 * 11/2004 Ashley ..... 36/54
6,952,864 B2 * 10/2005 Moreno ..... 24/712.3
6,988,298 B2 * 1/2006 Ternasky et al. ..... 24/712.3

* cited by examiner

*Primary Examiner*—Robert J Sandy
*Assistant Examiner*—Marcus Menezes
(74) *Attorney, Agent, or Firm*—Allen D. Hertz

(57) ABSTRACT

The invention is for a lace gripper comprising an upper body and a lower body that may be joined together whereby a tied lace is secured between the two bodies. Preferable the upper body is designed to receive inserts, charms, lights, recording devices, alarm and locating audible signals and locating devices, to allow the user to customize the lace gripper to their personal preference. The lace gripper can additionally be utilized to maintain a memo and would be secured to an object of daily use, such as a key ring or purse.

16 Claims, 4 Drawing Sheets

LACE SECURING APPARATUS

BACKGROUND OF THE INVENTION

1. Field of the Invention

The invention relates generally to an apparatus for securing laces of a shoe. The apparatus comprises a folded piece of material that can wrap around adjoined laces to ensure that said laces stay adjoined.

2. Description of the Prior Art

There currently exist several methods for securing adjoined, or tied, laces. Often these methods involve the use of fine motor skills to engage the laces. The problem of laces becoming untied is typical for all shoes containing laces. For most adults this is an annoyance that is easily overcome by the re-tying of the lace. Most adults have life experience that teaches them to retie their laces so that a dangerous accident can be avoided from the tripping over of untied laces. However, children often over look this danger because they lack life experience or the untied lace goes unnoticed. In addition, there are several occasions where adults will also notice that a lace is untied until it is pointed out to them or they trip on the lace. Therefore, there is a need to have an invention that is inexpensive, easy to use and desirable to use to prevent laces from coming untied.

The invention, in its simplest form, must be inexpensive because the use of the lace gripper will be primarily by children and they tend to destroy and lose attachable items. In addition the safety feature has to fit into a family budget.

The invention must be easy to use because the primary market to the lace gripper is going to be small children and adults who will not or cannot retie their laces.

The invention must be desirable to the user because children must want to use the lace gripper in order for it to be an effective safety measure.

The invention must keep laces secured because the safety feature is to eliminate the tripping over of laces.

The invention is also useful for adults that may not be able to tie their laces when they come undone. For example, athletes may not want to interrupt their athletic perform to tie their laces. In addition, adults may have disabilities that make it impossible or difficult to tie or retie their laces. Thus an invention to secure a tied lace is desirable for these individuals.

The invention should have optional features for users who desire more safety and are less concerned about price. These features should include signaling means to both sound and alarm and locate the user.

Past efforts have attempted to solve the problem of untied laces by providing complicated devices that integrate with laces to secure one end of the lace to another. In addition, these methods do not offer interchangeability in design that would make them universally appropriate for securing laces. An example of how these prior inventions are limited are that they require a more complicated securing process and they have only one outwardly appearance that may not be desirable or appropriate for the laces that are being secured.

None of the prior art couple the securing of laces with added security features such as sounds alarms or locating signals to find wayward users.

None of the prior art provides a means for presenting interchangeable images onto shoes.

Therefore, the present invention addresses the great need to develop an apparatus that is easy to use, inexpensive and desirable to use.

The present invention relates to a lace gripper that wraps around tied laces to secure the tied knot within.

The present invention further discloses an easy to use apparatus that wraps around tied laces to secure the tied knot within.

The present invention further discloses a desirable apparatus that wraps around tied laces to secure the tied knot within that may be changed in appearance to fit the activity being performed or appearance required by the user.

The present invention further discloses a desirable apparatus that wraps around tied laces to secure the tied knot within that may be configured with additional safety features from sounding alarms and locating wearers.

Nothing in the prior art references disclose an apparatus or method that utilizes a combination of these elements to facilitate the securing of tied laces.

SUMMARY OF THE INVENTION

According to the present invention, a lace gripper, or apparatus is disclosed.

An object of the present invention is to disclose an apparatus that is easy to use so that young children or disabled adults can use the present invention.

It is an object of this invention to provide an inexpensive apparatus that wraps around tied laces to secure the tied knot within, said apparatus referred to as a lace gripper.

A second objective is to disclose a desirable to use said apparatus that wraps around tied laces to secure the tied knot within, wherein said apparatus may be changed in appearance to fit the activity being performed or appearance required by the user.

A third objective is to disclose a desirable to use said apparatus that wraps around tied laces to secure the tied knot within, wherein said apparatus may have additional safety features for sounding alarms or locating signals for wayward wearers.

A fourth aspect of the present invention is the application of a fabric as a lace gripper, wherein said fabric comprising an outer surface and a joining surface. Said outer surface would be visible when used, said joining surface would be folded such to contact itself and therefore would not be visible when used.

A fifth aspect of the present invention is the inclusion of a fastener, wherein said fastener would be coupled to said joining surface of said fabric.

A sixth aspect of the present invention is the inclusion of a fastener, wherein said fastener would be coupled to said joining surface of said fabric, wherein said coupler is at least one of: Velcro@ (a dense hook and loop fastening system); a snap; a button; a ribbon or string tie, a hook and eye; and a loop and knot.

A seventh aspect of the present invention is the incorporation of a fabric stiffener, wherein said fabric stiffener would be coupled to said joining side of said fabric.

An eighth aspect of the present invention is the incorporation of a member to at least one of to hold and insert flat images.

A ninth aspect of the present invention is the incorporation of a member to at least one of to hold and insert flat images, wherein said member is a clear, flexible material, spanning across an upper, outer surface.

A tenth aspect of the present invention is the incorporation of a member to at least one of to hold and insert an image, wherein said member is narrow frame for containing said image on at least three sides.

An eleventh aspect of the present invention is the incorporation of a charm holder, wherein said charm holder.

A twelfth aspect of the present invention is the incorporation of a charm holder, wherein said charm holder is a charm bar coupled to said top, upper surface of said lace gripper.

A thirteenth aspect of the present invention is the incorporation of a charm holder, wherein said charm holder is a charm bar coupled to said top, upper surface of said lace gripper.

A fourteenth aspect of thpresent invention is the incorporation of a charm holder, wherein said charm holder is a horizontal strip of fabric incorporated in said top, upper surface of said lace gripper.

A fifteenth aspect of the present invention is the incorporation of a charm holder, wherein said charm holder is a charm chain coupled to said top, upper surface of said lace gripper.

A sixteenth aspect of the present invention is the incorporation of a charm holder, wherein said charm holder is at least one of a tie and ribbon coupled to said top, upper surface of said lace gripper.

A seventeenth aspect of the present invention is the utilization of said invention as a means to hold a daily tasks list.

An eighteenth aspect of the present invention is the utilization of said invention as a means to hold a daily tasks list, wherein said lace gripper is secured to a person's purse.

A nineteenth aspect of the present invention is the utilization of said invention as a means to hold a daily tasks list; wherein said lace gripper is secured to a person's key ring.

A twentieth aspect of the present invention is the utilization of printed fabric as the primary material for said lace gripper. Several examples would be utilization of cartoon characters, sports logos, sports related images, and the like.

A twenty-first aspect of the present invention is the utilization of leather, suede, silk, satin, lace and other materials for said fabric as the primary material for said lace gripper.

A twentieth aspect of the present invention is the utilization of a metal coupling apparatus, wherein said metal coupling apparatus is shaped similar to a clothes hanger and used to couple said lace gripper to another object such as a key-ring.

Still further objectives will become apparent from the disclosure herein and are claimed as objects of the invention as if described herein.

BRIEF DESCRIPTION OF THE DRAWINGS

The preferred embodiments of the invention will hereinafter be described in conjunction with the appended drawings provided to illustrate and not to limit the invention, where like designations denote like elements, and in which.

DETAILED DESCRIPTION OF THE PREFERRED EMBODIMENTS

Shown throughout the figures, the present invention is directed towards a lace gripper. Like element references are used through the various figures.

Figure 1:
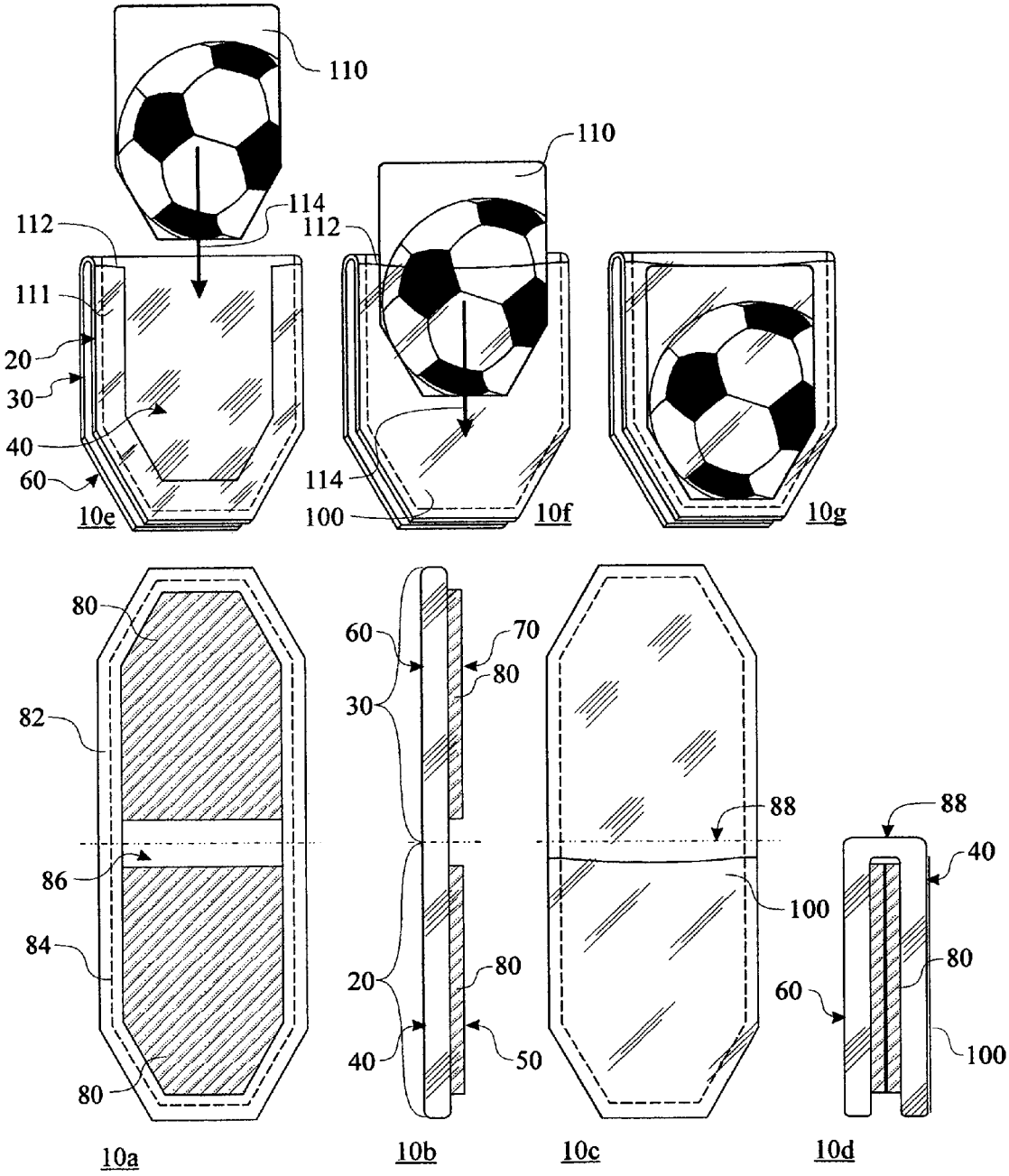
FIG. 1 presents a detailed view of a lace gripper, further comprising an embodiment allowing for the insert of various images.

FIG. 1 illustrates a lace gripper 10 (shown as 10A-10*p* herein), said lace gripper comprising a lace gripper upper body 20 and a lace gripper lower body 30. Said lace gripper upper body 20 has an upper body outer surface 40 and an upper body joining surface 50. Said lace gripper upper body 20 is the portion of said lace gripper 10 that is visible when used. Said lace gripper lower body 30 has a lower body outer surface 60 and a lower body joining surface 70. Said lace gripper lower body 30 is the portion of said lace gripper 10 that is not visible when used, placed behind said lace gripper upper body 20. Said upper body joining surface 50 and said lower body joining surface 70 further comprise an interlocking means 80 used as a means for securing said upper body joining surface 50 and said lower body joining surface 70, forming a loop about an object such as laces. In one embodiment interlocking means 80 is Velcro®. However, any means for joining said upper body joining surface 50 and said lower body joining surface 70 is contemplated herein whereby tied laces may be clamped in between said upper body joining surface 50 and said lower body joining surface 70, including, but not limited to a snap; a button; a ribbon or string tie, a hook and eye; and a loop and knot.

Optionally, said upper body outer surface 40 may have an attaching means (shown as several members herein) to attach various aesthetic items to make the use of said lace gripper 10 more appealing to the user. Said lace gripper 10 is presented in 4 orientations: an unfolded bottom/joining section view 10*a*, an unfolded side view 10*b*, an unfolded top/outer section view 10*c*, and a folded side view 10*d*. In one embodiment, said upper body outer surface may comprise a pocket/channel 100 completely covering (or an image slot 111 disposed around the perimeter of) said upper body outer surface 40. Said pocket/channel 100 (or said image slot 111 used interchangeably herein) will create an image pocket 112 for holding an insert 110. Said illustration presents the steps of inserting 114 said insert 110 into said image pocket 112, said process is detailed via: an orienting step 10*e* for orienting said insert 110 and aligning said insert with said pocket/channel 100; an insertion step 10*f* for inserting 114 said insert 110 into said pocket/channel 100; and seating step 10*g*, for seating said insert 100 to the base of said pocket/channel 100. Said insert 110 comprising printed card stock of various pictures to suit the personal preference of the user. For example, as shown in FIG. 1, a soccer ball may be imprinted on said insert 110, which would indicate the users fondness or participation in the activity. Alternatively, said insert 110 can comprise notes for reminding the user of various tasks, inspiration phrases, dates such as a calendar or other such messages. There is no limitation contemplated on the subject matter of printed material on said insert 110. In fact, said insert 110 may be left blank in which case the user may design their own graphic on said insert 110. Moreover, there is no limitation on the means of attaching said insert 110 to said upper body outer surface 40. For example, said insert 110 and said upper body outer surface 40 may also be coupled via Velcro@ coupled on opposite joining sides, adhesive, and the like. The configuration of having said attaching means shown herein as a pocket/channel 100 allows the user to change said insert 110 easily to allow several aesthetic themes. Moreover said lace gripper 10 may be used without said insert 110 at all.

Said lace gripper 10 can be fabricated in accordance with the following process. A stiffening material 86 is coupled to said joining side of a sheet of fabric. An outline of said lace gripper 10 is transferred to said stiffened sheet of fabric. One such means to transfer said outline would be to cut the sheet of fabric to shape, including any seam allowance 82 as required. An optional attaching means is then positioned and coupled to said stiffened sheet of fabric. Any seam allowance 82 is folded under as shown in said unfolded bottom side view 10*a*. A seam 84 secures said seam allowance 82. Additionally, said seam 84 can be used to secure said attaching means. Alternatively, the cut edge of the material can be finished to avoid fraying by a process known as surging. Said interlocking means 80 are then coupled to said joining surfaces 50, 70. Said lace gripper is then folded along a fold 88 as illustrated in said folded side view 10*d*.

Figure 2:
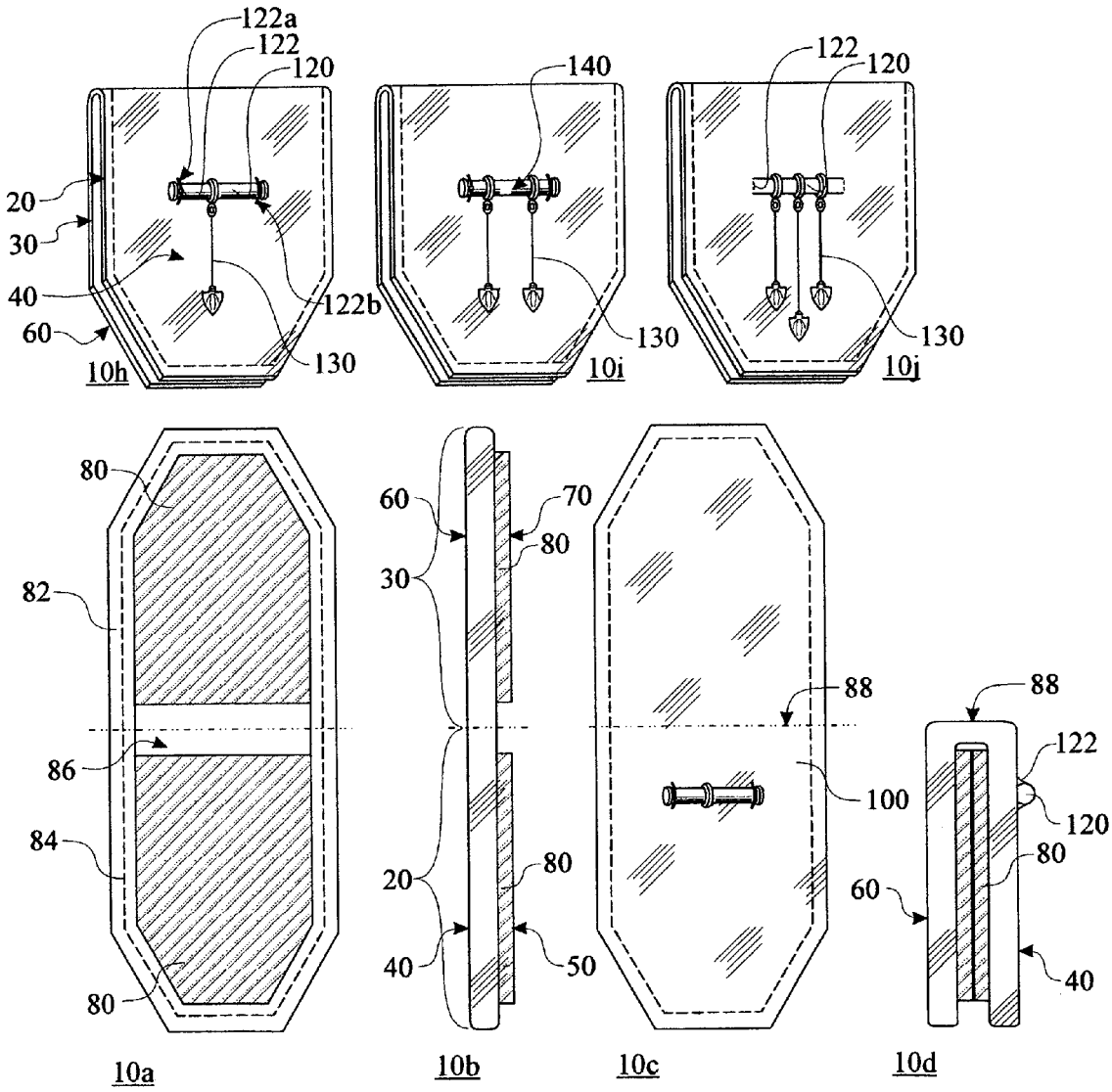
FIG. 2 presents a detailed view of the lace gripper, further comprising an embodiment allowing for the attachment of charms.

FIG. 2 presents a lace gripper 10 in accordance with an alternate embodiment, wherein said upper body outer surface 40 of said lace gripper 10 incorporates a charm attaching means 120 to attach user-selected charms 130. Said charms attaching means 120 is preferable a charm bar 140 secured to said upper body outer surface 40 via a charm attaching means coupling apparatus 122—more specifically, the preferred embodiment is a secured coupling member 122*a* at a first end and a removable coupling member 122*b* attached to said upper body outer surface 40 at an opposing end of said charm attaching means 120. By having one end of said charm bar 140 removable secured on one end the user may selectively add or remove said selected charms 130. Said selected charms 130 can be used for aesthetic appeal or used to convey membership, affiliation or approval of groups and activities symbolic. For example a group of friends can create a group of said selected charms 130 that represent the group of friends. Also, those involved in specific activities can select said charms 130 the represent those activities. In addition, said selected charms 130 can be matched to other jewelry being worn by the user to complete an their ouffit. In a modified version, said charm attaching means 120 can be a strip of fabric, string, ribbon, and the like as presented in FIG. 10*j*. Said modified charm attaching means could be fabricated by incorporating two horizontal slits into the fabric as shown. It can be recognized that any number of charm attaching scenarios can be incorporated into said lace gripper while maintaining the spirit and intent of the present invention.

Figure 3:
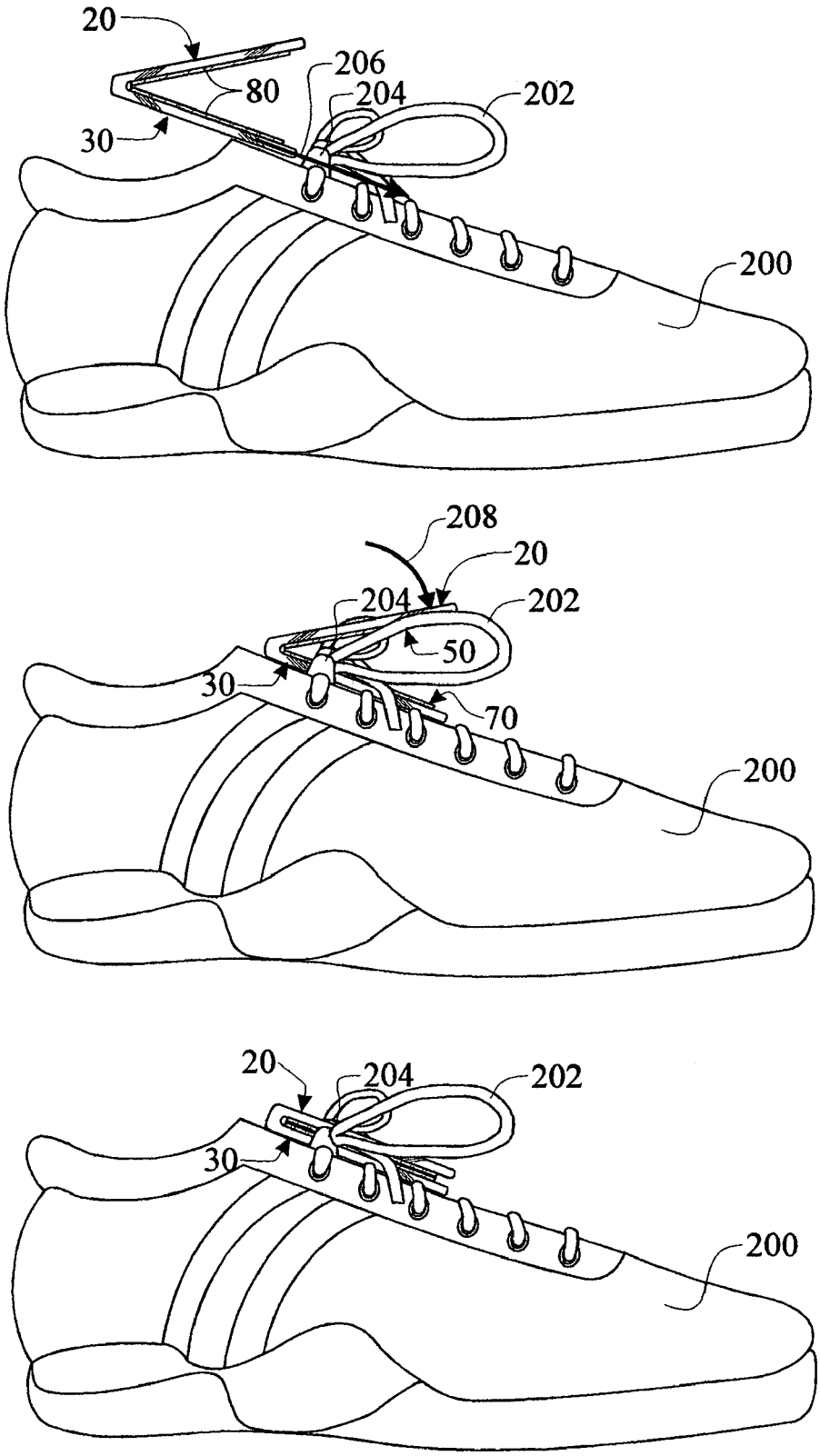
FIG. 3 presents a diagram illustrating the steps of inserting said lace gripper onto footwear and securely fastening said lace gripper around a tied knot; and, FIG. 4 presents various views of said lace gripper, further comprising additional embodiments of the present invention.

FIG. 3 presents a representative flow for applying said lace gripper to footwear 200 in accordance with the preferred embodiment. The method of using said lace gripper 10 comprising: inserting said lace gripper lower body 30 between the tongue of said footwear 200 (not shown, but widely understood) and laces 202 used to secure said footwear 200, while leaving said lace gripper upper body 20 extending outwardly from said laces 202. The preferable insertion location would be about a lace knot 204 to ensure said laces 202 remain tied. The midpoint (fold 88 position) of said lace gripper 10 should be positions at the point where said laces 202 will be tied (lace knot 204). Then the user tightens said laces 202 and ties said laces 202 of said footwear 200 as they normally would. It can be recognized that the user may tie said laces 202 prior to inserting said lace gripper 10. After which, said lace gripper upper body 20 is folded over 208 (along fold 88) about the tied laces (lace knot 204) until said upper body joining surface 50 and said lower body joining surface 70 are joined securing via said interlocking means 80. Thus the tied laces (lace knot 204) are secured between the two bonded surfaces of said lace gripper 10. Said inserts 110 or said selected charms 130 may have been previously positioned on said upper body outer surface 40 or may be so positioned or changed at this time.

Figure 4:
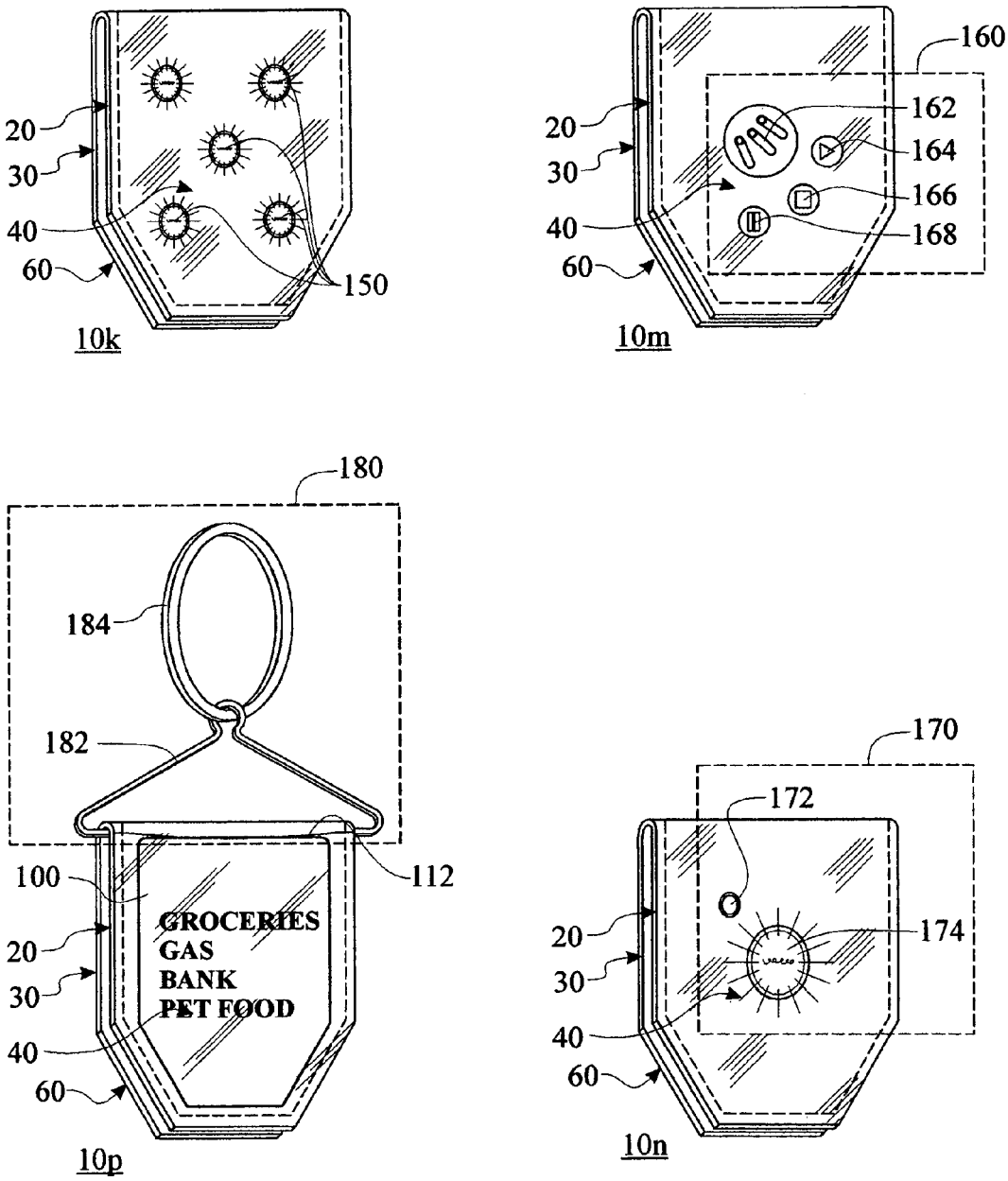

FIG. 4 presents additional embodiments not shown in the previous figures. In one such embodiment, said upper body outer surface 40 may incorporate or contain a desired pattern of lights 150, as illustrated in a lighting embodiment 10*k*. Currently, there are many shoes for children that have lights built into the shoes. However, these lights often become non-functioning prior to the useful life of the shoe. However, if said attached desired pattern of lights 150 is used it may be reenergized by the replacement of a battery or replaced altogether. Typically said desired pattern of lights 150 will be activated upon detection of motion. Alternately, said lights can be activated via a switch. Said lights can be incandescent bulbs, LEDs, fiber optics, and the like. Said lights can additionally flash, flash in patterns, etc. to gain attention. Said lights or ends of fibers can be fashioned into images.

In accordance with another alternate embodiment, attached to said upper body outer surface 40 may be a message-recording device 160, as illustrated in a recording embodiment 10*m*. Said message recording device 160 comprising a memory apparatus (not shown), a power source (not shown), a recording transducer 162, recording play controller 164, a recording stop controller 166, and a recording recorder controller 168. Said message recording device 160 could contain a recorded message from a parent reminding the child user to do something or conveying a message of endearment. Also, said recording device 160 could be used to store critical information like a home address or cell phone number in the event that a child gets lost. Additionally, said recording device could transmit an alarm or locating signal. Typically, said recording device 160 would be activated by depressing a button or remotely by a parent or caretaker.

In accordance with another alternate embodiment, either said lace gripper 10 or any of the said upper body outer surface 40 attachments may be fitted with a location device that allows a parent or caretaker to locate the position of the wearer utilizing wireless locating technology, as illustrated in a signaling embodiment 10*n*. This is accomplished through embedding a signaling device 170 in either the lace gripper 10 or any of the said upper body outer surface 40 attachments, and providing a receiving means to said parent or caretaker. Said signaling device 170 can optionally comprise a signaling device controller 172 and a signaling device warning apparatus 174. The wearer would activate said signaling device 170 via the said signaling device controller 172. Once activated, said signaling device 170 would transmit a signal back to said parent or caretaker. Optionally, said signaling device 170 would also provide an audible or visual alert via said signaling device warning apparatus 174.

In accordance with another alternate embodiment, said lace gripper 10 may be fitted with a lace gripper coupling apparatus 180 that provides a means for said lace gripper 10 to be secured to other objects such as a key-ring or purse, as illustrated in a note keeping embodiment 10*p*. Said lace gripper coupling apparatus 180 can comprise a lace gripper hanger 182 and optionally a coupling loop 184. Said hanger comprising a long, strait section for securing said lace gripper 10 and a smaller loop section for coupling to a key ring, loop on a purse, and the like.

Finally, it should be noted that all of the attachable features contained herein can be used in conjunction with each other or separately.

The primary goal of allowing user selection of various methods to display said inserts 110 and said selected charms 130 is to achieve the goal of getting the user to use said lace gripper 10.

The primary purpose of lace gripper 10 is to provide a means for securing shoe laces to avoid annoyance and provide safety to those would otherwise ignore untied laces and possibly trip over their untied laces.

An alternate purpose of lace gripper 10 is to provide a means for maintaining a task list or other such notes.

It should be noted, that the specific apparatus and method described of utilizing the present invention is only one example and is provided for illustrative purposes only. A wide variety of other applications and uses adaptable and configured for specific conditions are contemplated.

Since many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalents.

What is claimed is:

1. A lace gripper, said lace gripper comprising:

an upper body, wherein said upper body is of fabric;

a lower body, wherein said lower body is of fabric;

wherein said fabric is stiffened by a stiffening material;

said upper body and said lower body are connected via a foldable section;

a fastening member for fastening said upper body and lower body whereby tied laces of a shoe are secured between said bodies, wherein said fastening member is a dense hook and loop fastening system;

wherein said lace gripper is removable from said shoe; and at least one of:

a) an image pocket coupled to an outer surface of said upper body and an insert placed within said image pocket, wherein said image is viewable through said image pocket and b) a charm attaching member, wherein said charm attaching member is secured to an upper body outer surface via a secured coupling member at a first end of said charm attaching member and a removable coupling member at an opposing end of said charm attaching member.

2. A lace gripper as set forth in claim 1, comprising said charm attaching member, wherein said charm attaching member is coupled to said upper body of said lace gripper.

3. The lace gripper of claim 2, wherein said lace gripper wherein said charm attaching member comprising a charm bar secured to a upper body outer surface, wherein said upper body outer surface is visible when said lace gripper is worn.

4. The lace gripper of claim 1, wherein charm attaching member is a charm bar and wherein said removable coupling member is a loop that is removably coupled to said charm attaching member.

5. The lace gripper of claim 1, wherein an edge of said upper body and lower body is finished to avoid fraying.

6. The lace gripper of claim 1, said lace gripper comprising a charm attaching member and wherein at least one charm is coupled to said charm attaching member.

7. The lace gripper of claim 1, said lace gripper further comprising a plurality of charm attaching members.

8. A lace gripper, comprising:

an upper body, wherein said upper body is of fabric;

a lower body, wherein said lower body is of said fabric;

wherein said upper body and said lower body are of a contiguous having a unitary piece of said fabric width such to fit between each of a left and a right side of a lace inserted into a shoe;

wherein said fabric is stiffened by a stiffening material;

said upper body and said lower body are connected via a foldable section;

a fastening member for fastening said upper body and lower body whereby tied laces of a shoe are secured between said bodies, wherein said fastening member is a dense hook and loop fastening system;

wherein said lace gripper is removable from said shoe, and said upper body includes at least one of:

a) a recording device, b) a locating device, c) at least one lighting apparatus, d) a warning device, e) an image pocket coupled to an outer surface of said upper body and an insert placed within said image pocket, wherein said image is viewable through said image pocket, and f) a charm attaching member, wherein said charm attaching member is a thin, axial member coupled to said upper body of said lace gripper.

9. The lace gripper of claim 8, wherein said fabric is at least one of:

a printed material, leather, suede, satin, silk, and lace.

10. The lace gripper of claim 8, wherein an edge of said upper body and lower body is finished to avoid fraying.

11. The lace gripper of claim 8, said lace gripper further comprising a plurality of charm attaching members.

12. A lace gripper, said lace gripper comprising:

an upper body, wherein said upper body is of fabric;

a lower body, wherein said lower body is of fabric;

wherein said upper body and said lower body are contiguous having a width such to fit between each of a left and a right side of a lace inserted into a shoe;

wherein said fabric is stiffened by a stiffening material;

a charm attaching member coupled to an outer surface of said upper body, wherein said charm attaching member is a thin, axial member; and a fastening member for fastening said upper body and lower body whereby tied laces are secured between said bodies, wherein said fastening member is a dense hook and loop fastening system, and wherein said charm attaching member is secured to said upper body outer surface via a secured charm attaching member coupling member at a first end of said charm attaching member and a removable charm attaching member coupling member at an opposing end of said charm attaching member.

13. The lace gripper of claim 12, wherein charm attaching member is a charm bar and wherein said removable coupling member is a loop that is removably coupled to said charm bar.

14. The lace gripper of claim 12, wherein an edge of said upper body and lower body is finished to avoid fraying.

15. The lace gripper of claim 12, said lace gripper further comprising at least one charm, wherein said at least one charm is coupled to said charm attaching member.

16. The lace gripper of claim 12, said lace gripper further comprising a plurality of charm attaching members.

* * * * *